US007939735B2

(12) United States Patent
Ahn et al.

(10) Patent No.: US 7,939,735 B2
(45) Date of Patent: May 10, 2011

(54) STRINGED MUSICAL INSTRUMENT

(76) Inventors: Sunny Ahn, Los Angeles, CA (US); Hyo E. Ahn, Los Angeles, CA (US)

( * ) Notice: Subject to any disclaimer, the term of this patent is extended or adjusted under 35 U.S.C. 154(b) by 0 days.

(21) Appl. No.: 12/505,205

(22) Filed: Jul. 17, 2009

(65) Prior Publication Data

US 2011/0011237 A1 Jan. 20, 2011

(51) Int. Cl.
*G10D 1/04* (2006.01)

(52) U.S. Cl. ..... 84/265; 84/267; 84/286; 84/291; 84/264

(58) Field of Classification Search ..... 84/265, 84/286, 267, 292, 263, 299, 297 R, 291, 264; D17/15
See application file for complete search history.

(56) References Cited

U.S. PATENT DOCUMENTS

| | | | | | |
|---|---|---|---|---|---|
| 224,536 | A | * | 2/1880 | Holtz | 84/265 |
| 463,013 | A | * | 11/1891 | Van Deventer | 84/297 R |
| 463,368 | A | * | 11/1891 | St. John | 84/286 |
| 497,939 | A | * | 5/1893 | Abelspies | 84/263 |
| 526,630 | A | * | 9/1894 | Lehman | 84/265 |
| 612,005 | A | * | 10/1898 | Maggio | 84/263 |
| 660,953 | A | * | 10/1900 | Hammann | 84/308 |
| D34,476 | S | * | 5/1901 | Nordwall | D17/15 |
| 722,602 | A | * | 3/1903 | Moerscher | 84/264 |
| 812,049 | A | * | 2/1906 | Krueger | 84/267 |
| 831,471 | A | * | 9/1906 | Reinhard et al. | 84/263 |
| 860,137 | A | * | 7/1907 | Inskeep | 84/294 |
| 964,660 | A | * | 7/1910 | Laurian | 84/263 |
| 1,049,176 | A | * | 12/1912 | Varian | 84/264 |
| 1,183,369 | A | * | 5/1916 | Gardie | 84/263 |
| D64,034 | S | * | 2/1924 | Stoughton | D17/16 |
| 1,817,951 | A | * | 8/1931 | Starke | 84/264 |
| 2,113,446 | A | * | 4/1938 | Gugino | 84/293 |
| 3,051,033 | A | * | 8/1962 | Pratt | 84/265 |
| 3,515,026 | A | * | 6/1970 | Rohrbough | 84/286 |
| 3,869,954 | A | * | 3/1975 | Ito | 84/291 |
| 4,616,550 | A | * | 10/1986 | Lacroix et al. | 84/173 |
| 4,744,280 | A | * | 5/1988 | Garritano | 84/726 |
| 4,796,504 | A | * | 1/1989 | McWillis | 84/265 |
| 5,661,252 | A | * | 8/1997 | Krawczak | 84/291 |
| D395,443 | S | * | 6/1998 | Melcher et al. | D17/16 |
| 5,918,299 | A | * | 6/1999 | Yui | 84/291 |
| 5,922,979 | A | * | 7/1999 | Yui | 84/291 |
| 5,949,006 | A | * | 9/1999 | Hechler | 84/291 |
| 6,459,024 | B1 | * | 10/2002 | Baker | 84/291 |
| 6,608,247 | B2 | * | 8/2003 | Bryan | 84/291 |
| 6,639,135 | B1 | * | 10/2003 | Lucas | 84/291 |
| 7,081,576 | B1 | * | 7/2006 | Daoud | 84/411 R |
| 7,211,719 | B2 | * | 5/2007 | Blake | 84/290 |

(Continued)

OTHER PUBLICATIONS

Miner, Gregg, Harp Guitar & Related Patents © 2004,2005, 2006, 2007, 2008, 2009, viewed Feb. 19, 2010 at http://www.harpguitars.net/history/patents.htm.*

(Continued)

*Primary Examiner* — Elvin G Enad
*Assistant Examiner* — Robert W Horn
(74) *Attorney, Agent, or Firm* — Seth D. Levy; Davis Wright Tremaine LLP

(57) ABSTRACT

The present subject matter relates to novel soundboard apparatus for stringed musical instruments. Specifically, the present subject matter teaches an apparatus capable of enhanced phonetic quality, improving the phonetic consistency of a stringed musical instrument, and enhancing resonance in a stringed musical instrument, all while reducing construction cost and reducing the cumbersome size associated with similarly stringed musical instruments.

12 Claims, 3 Drawing Sheets

U.S. PATENT DOCUMENTS

| | | | | |
|---|---|---|---|---|
| 7,227,067 | B2 * | 6/2007 | Tarpinian | 84/291 |
| 7,273,976 | B2 * | 9/2007 | Bennett | 84/285 |
| 7,446,247 | B2 * | 11/2008 | Shellhammer | 84/291 |
| 7,498,495 | B1 * | 3/2009 | Mooers | 84/265 |
| 7,507,885 | B2 * | 3/2009 | Coke | 84/291 |
| 7,534,954 | B1 * | 5/2009 | Cassista | 84/731 |
| 7,674,962 | B2 * | 3/2010 | Gonzalez Ramirez | 84/264 |
| 2005/0076764 | A1 * | 4/2005 | Davis | 84/299 |
| 2006/0123971 | A1 * | 6/2006 | Moghaddam | 84/290 |

OTHER PUBLICATIONS

Historic Harp Guitar, citing features of claimed invention viewed Feb. 19, 2010 at http://www.harpguitars.net/history/org__images/Harp-lutes/harp-lute-v&a-miner-b.jpg.*

Balalaika—Russian music instrument © 2007 also newpaper Crimean Truth 1983. by Dmitry Belinskiy, viewed at http://skaz1.com/balalaika.engl.html on Aug. 19, 2010.*

* cited by examiner

STRINGED MUSICAL INSTRUMENT

FIELD OF THE SUBJECT MATTER

The present field of the subject matter relates to stringed musical instruments. More specifically, the present subject matter relates to a harp, which is a stringed instrument with the plane of its strings positioned substantially perpendicular to ground and/or a soundboard.

BACKGROUND OF THE SUBJECT MATTER

All publications herein are incorporated by reference to the same extent as if each individual publication or patent application was specifically and individually indicated to be incorporated by reference. The following description includes information that may be useful in understanding the present subject matter. It is not an admission that any of the information provided herein is prior art or relevant to the presently claimed subject matter, or that any publication specifically or implicitly referenced is prior art.

The harp is a stringed musical instrument consisting of a rigid, triangular frame within which are stretched a set of substantially parallel strings. The strings run between the top, or neck, of the harp, to the resonator/soundboard. The neck and soundboard are joined together, with the strings set at an oblique angle to the soundboard. (By contrast, in other harp-like instruments such as the lyre and zither, the strings run parallel to the soundboard). Ancient and primitive harps lacked the third rigid member of contemporary frame harps, termed the pillar or column, which extends from the neck down to the lower end of the soundboard. The strong structure provided by the column allows for increased string tension that produces notes of a higher pitch than was possible with early harps. The instrument is generally placed on the floor in front of the harpist and played by tilting it back so that the instrument rests against the harpist's shoulder and plucking the strings from either or both sides with the fingers of the hand(s). Alternatively, the instrument may be placed on the lap of the harpist and played in a like fashion.

The modern concert harp stands approximately 170 cm high (5.5 ft) and has the largest phonetic range of any instrument in an orchestra: more than 6 ½ octaves (from the lowest C on the piano to the highest G). Its structure consists of a tapering, hollow body covered with a thin wooden plank (the "soundboard"), a doubly curved neck that carries a set of tuning pins, and a straight column. At the base of the modern concert harp are seven pedals, one for each degree of the diatonic scale. These pedals, mechanically connected through the pillar to two rows of rotating pronged discs placed under all of the strings for each degree of the scale either a semitone (pedal at half hitch activating discs in the first row) or a whole tone (pedal fully depressed activating discs in the second row). Thus the instrument is totally chromatic (a sequence of notes proceeding by semitones). The harp is strung in gut or nylon in the upper and middle registers. The bass strings are generally of over-spun wire.

The chromatic flexibility offered by the concert harp, along with a growing desire for orchestral color, makes the harp increasingly appealing to musicians and composers. Historically, the instrument has enjoyed being a regular member of the orchestra of Berlioz, Wagner, and Tchaikovsky. However, the overgrown size, weight and cost associated with modern day concert harp renders the instrument inaccessible to a majority of would-be harpists, composers and musicians.

In operation, the harp is played by plucking the strings with the pad of the fingers to make a warm, mellow tone, or to use the tip of the fingers creating a sharper sound. Harp players use all of the fingers except for the little finger, which is generally too short and weak to effectively pluck a string. Most types of harps only require use of the hands, with the exception of the concert harp, in which the feet are also used to operate foot pedals. The plucking of strings create resonance which excites air molecules, creating sound. The soundboard enhances the volume and tone of the sound created by plucking the strings, and enables the instrument to amplify and produce a clean, focused, natural sound.

Sound is amplified by resonating through the soundboard and is presented to the listening audience through sound holes found on the backside of the harp instrument. The sound holes are found on the backside of the harp instrument by necessity, as the front of the soundboard captures the strings. As the harpist is also positioned on the backside of the harp instrument, sound presented through the sound holes may be diffracted and compressed by the harpist before reaching the intended audience. This diffraction may compromise the intensity and purity of sound presented, creating a compromised auditory experience.

Furthermore, present stringed instrument designs suffer from design flaws. Existing stringed instruments attach the column at the bottom of the soundboard closest to the bass strings. In the case of a harp, the column is attached to the soundboard by a large wood screw or bolt that passes through the column and soundboard. Variations in design have eliminated this wood screw or the use of a bolt at this point, but as a general matter, the resistance to the tension of the strings on the board remains concentrated in one small area at the bottom of the soundboard. This area is referred to as the "yoke" and is one of the most troublesome parts of a harp. Other than creating a point of design weakness, the attachment of the column near the bass strings compromises the quality of sound and reduces resonance, leading many instrument players to resist using the very lowest strings. Accordingly, the amount of resonance created by the soundboard near the column is restricted and so stiff that it can only produce about a quarter of the response found at other positions along the soundboard.

Thus, there exists a need in the art for a stringed instrument capable of delivering clean, sharp notes with reduced incidents of diffraction. In addition, there is a need in the art for an economical, quality stringed instrument capable of producing a wide spectrum of chromatic sound, that is smaller and more accessible than the modern day concert harp. Finally, there is need in the art to produce a soundboard for a stringed instrument, wherein minimal deviance of resonance is accomplished throughout the length of the soundboard.

SUMMARY OF THE SUBJECT MATTER

The following embodiments and aspects thereof are described and illustrated in conjunction with apparatus are meant to be exemplary and illustrative, not limiting in scope.

While the description below refers to particular embodiments of the present subject matter, it should be readily apparent to people of ordinary skill in the art that a number of modifications may be made without departing from the spirit thereof, including the use of alternate materials, components, mechanisms, compositions. The accompanying claims are intended to cover such modifications as would fall within the true spirit and scope of the subject matter. All changes that come within the meaning of and range of equivalency of the claims are intended to be embraced therein The present subject matter comprises a new soundboard apparatus for stringed musical instruments, as well as a new stringed musical instrument. The subject matter is capable of enhanced phonetic quality, improving the phonetic consistency of a stringed musical instrument, and enhancing resonance in a stringed musical instrument, all while reducing construction cost and eliminating the cumbersome size associated with similarly stringed musical instruments. The present subject matter further discloses a means for producing a wide spectrum of chromatic sound using the contemplated soundboard and stringed musical instrument. Application of the present subject matter may be utilized on various stringed instruments including, lyres, aeolian harps, autoharps, kitharas and other zither family instruments.

In one embodiment, the present subject matter teaches a stringed musical instrument comprising a soundboard, having an upper plate, rear plate and side walls to form a hollow core, a curved neck connected to the upper end of the soundboard, and a substantially vertical column found at the other end of the neck extending down to about the mid point of the soundboard. In combination, the soundboard, neck and column establish a triangular interval. The harp strings are stretched in the triangular interval between the neck and the soundboard, substantially parallel to the column, and are secured to a strip that is fixed centrally and axially on one or both sides of the soundboard. The lower portion of the soundboard encompasses at least one sound hole for disseminating sound resonating from the soundboard, whereas the sound hole is situated in the upper plate for direct dissemination of sounds to the listening audience.

In yet another embodiment, the present subject matter teaches a method for eliminating the deleterious effects of the column on the bass tones of a stringed musical instrument, by attaching the column at about the mid point of the soundboard.

In another embodiment, the present subject matter teaches a method for structurally strengthening a stringed instrument by attaching the column at about the mid point of the soundboard, allowing for greater vibrational freedom in the soundboard.

Another embodiment of the present subject matter teaches a stringed instrument with the soundboard constructed of thin materials, such as several thicknesses of veneer stock glued and cross-laminated to give it strength in two dimensions.

A further embodiment of the present subject matter teaches the use of bracing to resist deformation of the soundboard caused by the pull of the strings on the soundboard. Bracing may be placed inside the soundboard behind the notches found at regular intervals. This bracing can be of wood, metal, composite, or combinations thereof.

In yet another embodiment of the subject matter, the soundboard comprises at least one sound hole situated in the rear plate of the soundboard.

In another embodiment, the subject matter teaches an improved soundboard for use in stringed instruments. In this regard, the subject matter soundboard may be applied to instruments such as lyres, aeolian harps, autoharps, kitharas and other zither family instruments. The contemplated soundboard is situated such that the upper plate of the soundboard contains at least two notches for securing a string to each notch on the soundboard by knots or similar means, whereas the notches commence at about the midline of the upper plate of the soundboard and continue longitudinally towards the superior end of the soundboard. The upper plate of the soundboard also contains at least one sound hole for disseminating sound resonating from the soundboard, whereas the at least one sound hole is situated between the midline and inferior end of the upper face of the soundboard. The sound hole is situated in the upper face of the soundboard allowing for the unobstructed dissemination of sound from the soundboard to the listening audience.

In yet another embodiment, the present subject matter teaches a method for eliminating the deleterious effects of the column on the bass tones of the soundboard by attaching the column at about the mid point of the soundboard.

In another embodiment, the present subject matter teaches a method for structurally strengthening the soundboard of a stringed instrument by attaching the column at about the mid point of the soundboard, which eliminates structural problems at the "yoke", and tangentially allows for greater vibrational freedom in the soundboard.

Another embodiment of the present subject matter teaches a soundboard constructed of thin materials, such as several thicknesses of veneer stock glued and cross-laminated to give it strength in two dimensions. Additional bracing to resist deformation caused by the pull of the strings on the soundboard is typically placed inside the soundboard behind the notches found at regular intervals. This bracing can be of wood, metal, composite, or combinations thereof. The pull of the strings imparts an upward curve to the soundboard which, because the soundboard is rigidly connected to the case, translates into a force that brings the edges of the sound case closer together. Bracing is needed to resist this pull.

In another embodiment of the subject matter, the soundboard comprises at least one sound hole situated in the rear plate of the soundboard. Furthermore, the soundboard may contain a securing strip that is fixed centrally and axially on one or both sides of the soundboard, for bracing the strings to the soundboard, thus reducing deflection in the soundboard surface.

BRIEF DESCRIPTION OF THE FIGURES

Exemplary embodiments are illustrated in referenced figures. It is intended that the embodiments and figures disclosed herein are to be considered illustrative rather than restrictive.

DETAILED DESCRIPTION OF THE SUBJECT MATTER

All references cited herein are incorporated by reference in their entirety as though fully set forth. Unless defined otherwise, technical terms used herein have the same meaning as commonly understood by one of ordinary skill in the art to which the subject matter belongs. One skilled in the art will recognize many methods and materials similar or equivalent to those described herein, which could be used in the practice of the present subject matter. Indeed, the present subject matter is in no way limited to the methods and materials described.

The present subject matter comprises a new soundboard apparatus and design for stringed musical instruments, as well as a new stringed musical instrument and design, both configured to enhance phonetic quality, improve the phonetic consistency of a stringed musical instrument, and enhance the resonance in a stringed musical instrument, all while reducing construction cost and eliminating the cumbersome size associated with comparable stringed musical instruments. The present subject matter further discloses a means for producing a wide spectrum of chromatic sound using the contemplated soundboard and stringed musical instrument. Application of the present subject matter may be utilized on various stringed instruments including, lyres, aeolian harps, autoharps, kitharas and other zither family instruments.

The soundboard disclosed herein improves upon the phonetic quality of existing stringed instruments by allowing the vertical column to be mounted at or about the center of the soundboard. The contemplated orientation of mounting for the vertical column eliminates or substantially reduces phonetic inconsistencies observed at the "yoke" of common stringed instruments, thus allowing for greater variance in the spectrum of chromatic sound. This is accomplished by providing greater vibrational freedom in the soundboard, as the column is longer attached to the base of the soundboard. In addition, the contemplated orientation of mounting the vertical column to about the center of the soundboard allows for placement of sound holes in the lower portion of the upper plate of the soundboard. The placement of sound holes in the upper plate allows sound resonating in the soundboard to be disseminated from the front of the musical instrument directly to the listening audience. The unobstructed dissemination of sound from the musical instrument through the sound hole to the audience leads to enhanced phonetic quality and a cleaner presentation of sound by the instrument. Furthermore, the contemplated orientation of mounting the vertical column to about the center of the soundboard reduces the cumbersome size of modern concert harps, as well as reducing the cost of production and maintenance, all the while enhancing the phonetic and chromatic qualities of the stringed musical instrument.

Figure 1:
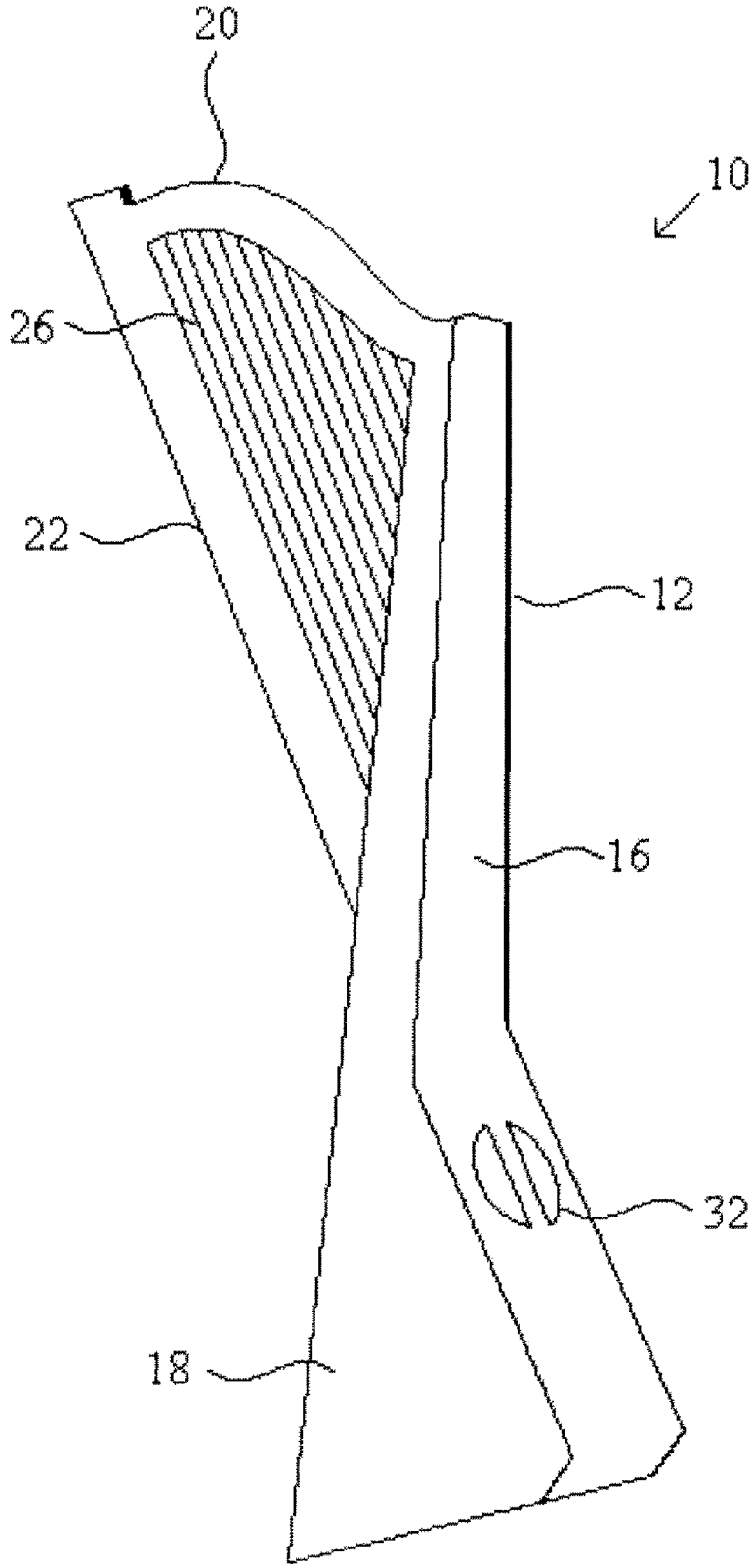
FIG. 1 depicts a stringed musical instrument in accordance with an embodiment of the present subject matter.
Figure 2:
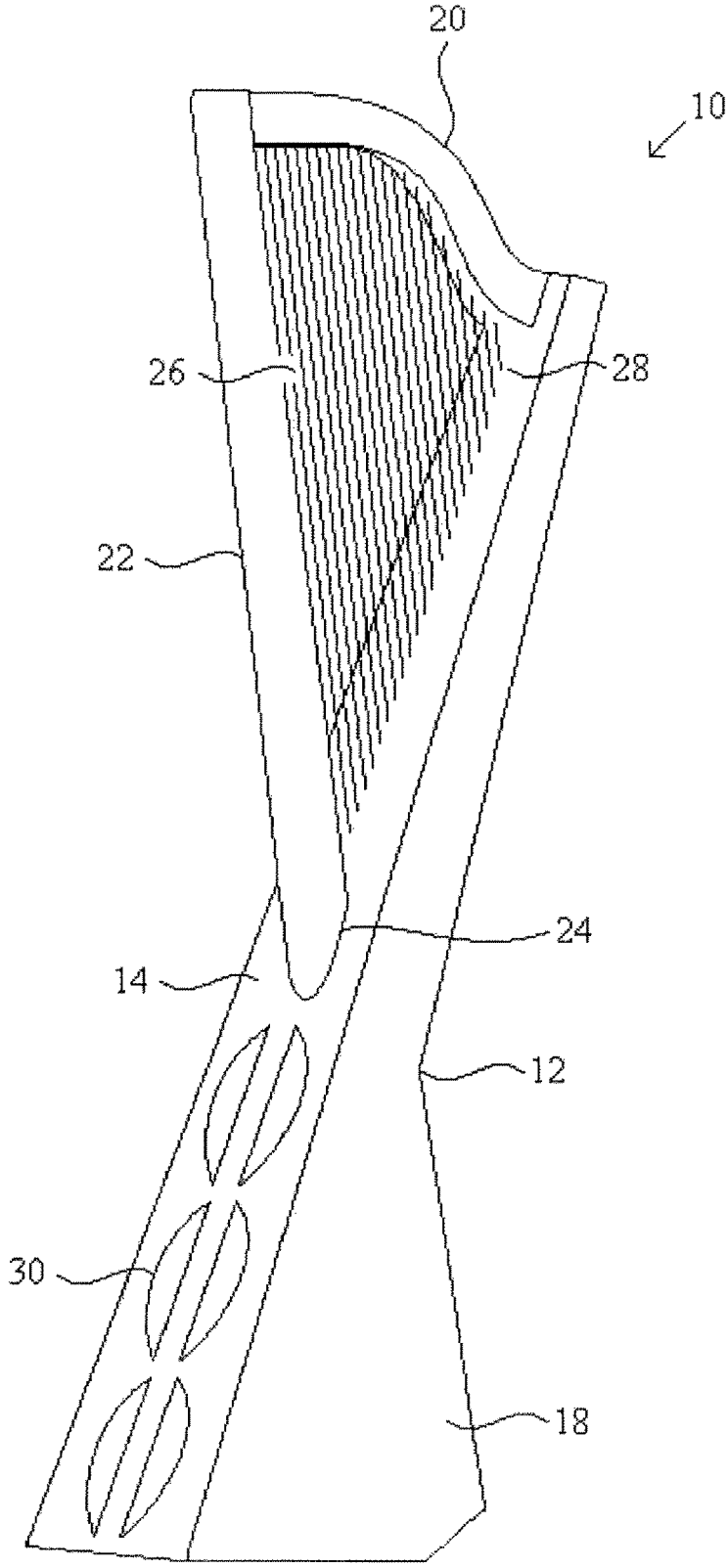
FIG. 2 depicts a stringed musical instrument in accordance with an embodiment of the present subject matter.

As seen in FIGS. 1 and 2, the present subject matter teaches a stringed musical instrument 10 comprising a soundboard 12, having an upper plate 14, rear plate 16 and side walls 18 to form a hollow core, a curved neck 20 is connected to the upper end of the soundboard 12, and a substantially vertical column 22 is connected at the opposite end of the neck 20, whereas the column 22 extends down to about the mid point of the soundboard 12. In combination, the soundboard 12, neck 20 and column 22 establish a triangular interval. Harp strings 26 are stretched in the triangular interval between the neck 20 and the soundboard 12, substantially parallel to the column 22, and are secured to a strip 28 that is fixed centrally and axially on one or both sides of the soundboard 12. The pull of the strings 26 is resisted on the bass end by the column 22 and on the treble end by the neck 20. The curvature of the neck 20 is the result of an effort to employ lengths that are correlated to the thicknesses of the strings 26 so as to yield a pleasant tone when the strings 26 are plucked. The lower portion of the soundboard 12 encompasses at least one sound hole 30 for disseminating sound resonating from the soundboard 12, wherein the sound hole 30 is situated in the upper plate 14 of the soundboard 12 for direct dissemination of sounds to the listening audience.

The present subject matter further teaches the elimination of the deleterious effect of the column on the bass tones of a stringed musical instrument. As stated prior, common stringed instruments place the end of the column at the bottom of the soundboard closest to the bass strings. This area is referred to as the "yoke" and due to the positioning of the column near the bass strings, sound produced by these strings are inaccurate and lead to a compromise in sound quality and instrument structure.

By attaching the column away from the bottom of the soundboard this weakness in the design of the yoke is eliminated, and the soundboard is allowed greater resonance and flexibility, resulting in greater and more consistent vibrational freedom in the soundboard. The improvements in vibrational freedom result in a broader and more accurate range of tones in the instrument, the favorable use of all strings providing a mellower sound.

Figure 3:
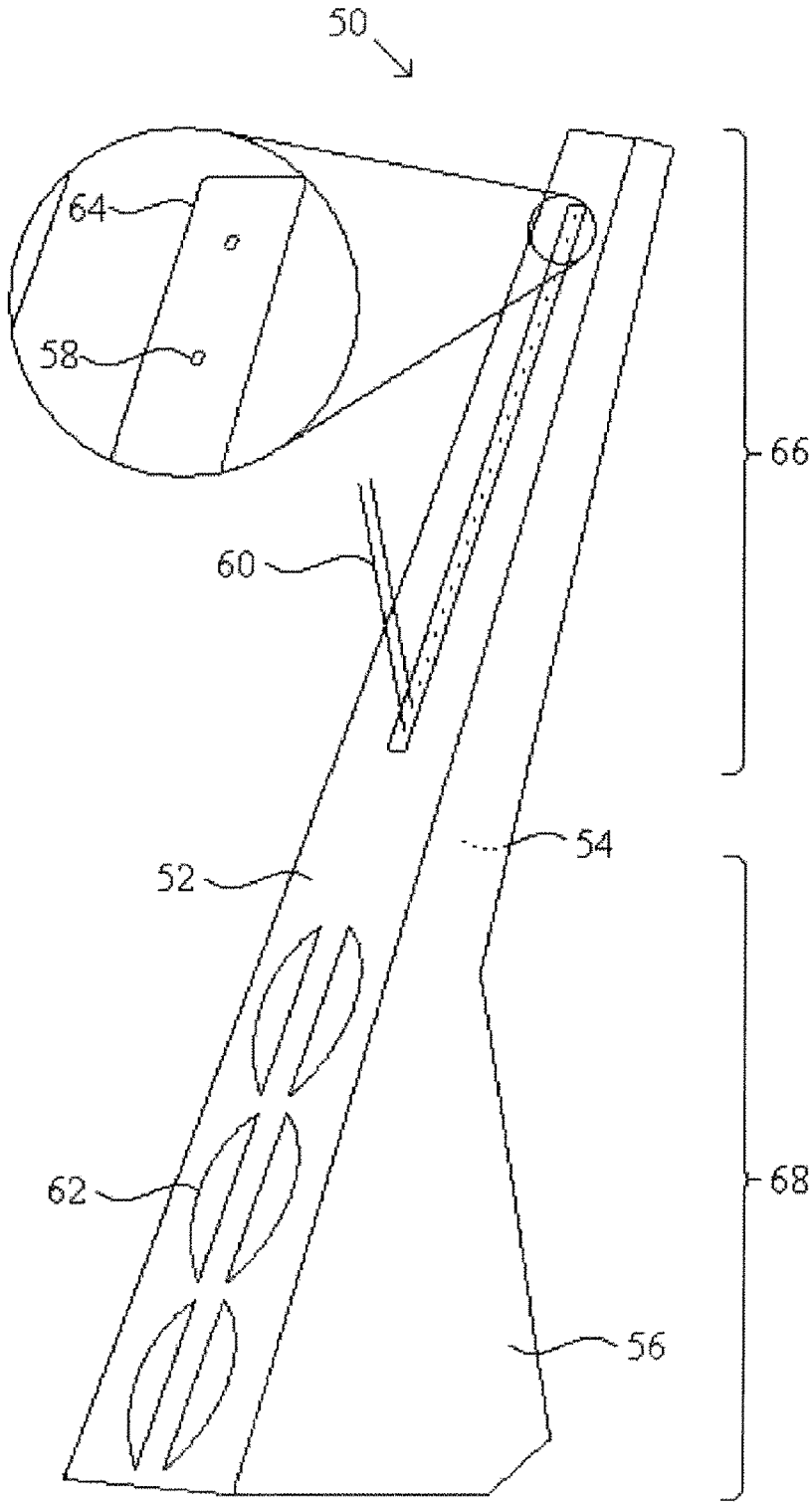
FIG. 3 depicts a soundboard for a stringed musical instrument, including an expanded view of the bracing and notches, in accordance with an embodiment of the present subject matter.

FIG. 3 depicts an improved soundboard 50, in accordance with the present subject matter, for use in stringed instruments. In this regard, the subject matter soundboard 50 may be applied to instruments such as lyres, aeolian harps, autoharps, kitharas and other zither family instruments. The contemplated soundboard 50 comprises an upper plate 52, rear plate 54 and side walls 56 to form a hollow core. The soundboard 50 is situated such that the upper plate 52 of the soundboard 50 contains at least two notches 58 for securing a string 60 to each notch 58 on the soundboard 50 by knots or similar means, whereas the notches 58 commence at about the midline of the upper plate 52 of the soundboard 50 and continue longitudinally towards the superior end 66 of the upper plate 52 of the soundboard 50. The upper plate 52 of the soundboard 50 also contains at least one sound hole 62 for disseminating sound created by the strings 60 and resonating from the soundboard 50, wherein the at least one sound hole 62 is situated between the midline and inferior end 68 of the upper plate 52 of the soundboard 50.

The soundboard may be constructed of thin materials, such as several thicknesses of veneer stock glued and cross-laminated to give it strength in two dimensions. As seen in FIG. 3, bracing 64, to resist deformation caused by the pull of the strings 60 on the soundboard 50, is typically placed inside and/or upon the soundboard 50 adjacent to the notches 58 found at regular intervals. This bracing 64 can be of wood, metal, composite, or combinations thereof. The pull of the strings 60 imparts an upward curve to the soundboard 50 which translates into a force that brings the edges of the soundboard 50 closer together. Bracing 64 is needed to resist this pull.

In another embodiment of the subject matter, depicted in FIG. 1, the soundboard 12 comprises at least one sound hole 32 situated in the rear plate 16 of the soundboard 12. Furthermore, the soundboard may contain bracing 64 that is fixed centrally and axially on one or both sides of the soundboard, for bracing the strings to the soundboard, thus reducing deflection in the soundboard surface.

What is claimed is:

1. A soundboard assembly for a stringed instrument, comprising:

an upper plate comprising an upper portion adjacent a string mounting parts of a stringed instrument and a lower portion below and away from the string mounting parts, two triangular sidewalls, a rear plate comprising upper and lower portions, the upper plate, sidewalls, and rear plate assembled together to form a hollow core between the lower portions of the upper and rear plates and the triangular side walls, wherein the hollow core comprises a substantially triangular shaped chamber extended downward from said string mounting parts in a direction into the apex of the triangular shape and toward the base of the triangular shape, and at least one sound hole in the lower portion of the upper plate of the soundboard.

2. The soundboard assembly for a stringed instrument according to claim 1, wherein the soundboard contains at least two notches for attachment of at least two strings.

3. The soundboard assembly for a stringed instrument according to claim 1, further comprising a strip fixed at a central position along the width direction on one or both sides of the upper plate for securing at least two strings.

4. The soundboard assembly for a stringed instrument according to claim 3, wherein the strip is selected from a group consisting of wood, metal, composite, and combinations thereof.

5. The soundboard assembly for a stringed instrument according to claim 1, wherein the upper plate of the soundboard is constructed of a thin material several thicknesses of veneer stock glued and cross-laminated.

6. The soundboard assembly for a stringed instrument according to claim 1, further comprising at least one sound hole situated in the rear plate of the soundboard.

7. A musical apparatus, comprising:

a soundboard having an upper plate, a rear plate, and two side walls assembled together to form a hollow core, wherein the hollow core comprises a substantially triangular shaped chamber extended downward comprising a lower portion of the upper plate, a lower portion of the rear plate, and the lower portion of the two side walls;

a curved neck attached to a upper end of the soundboard at one end of the neck;

a column attached to about a mid point of the soundboard at one end of the column and attached to an opposing end of the curved neck at the other end of the column;

at least two strings connected and stretched between the soundboard and curved neck; and at least one sound hole in the lower portion of the upper plate of the soundboard.

8. The apparatus according to claim 7, wherein the soundboard contains at least two notches for attachment of the at least two strings.

9. The apparatus according to claim 7, further comprising a strip fixed at a central position along the width direction on one or both sides of the upper plate for securing the at least two strings.

10. The apparatus according to claim 9, wherein the strip is selected from a group consisting of wood, metal, composite, and combinations thereof.

11. The apparatus according to claim 7, wherein the soundboard is constructed of a thin material several thicknesses of veneer stock glued and cross-laminated.

12. The apparatus according to claim 7, further comprising at least one sound hole situated in the rear plate of the soundboard.

* * * * *